US008590695B2

(12) United States Patent
Moreno Rueda

(10) Patent No.: US 8,590,695 B2
(45) Date of Patent: Nov. 26, 2013

(54) TECHNIQUES FOR THE CONVEYANCE OF SOLID COMBUSTIBLE MATERIAL

(75) Inventor: Rafael Moreno Rueda, Alpen (DE)

(73) Assignee: Clyde Bergemann DRYCON GmbH, Wesel (DE)

( * ) Notice: Subject to any disclaimer, the term of this patent is extended or adjusted under 35 U.S.C. 154(b) by 116 days.

(21) Appl. No.: 12/975,817

(22) Filed: Dec. 22, 2010

(65) Prior Publication Data

US 2011/0147165 A1 Jun. 23, 2011

(30) Foreign Application Priority Data

Dec. 23, 2009 (DE) ..... 20 2009 017 450 U

(51) Int. Cl.
*B65G 25/00* (2006.01)
*B65G 45/20* (2006.01)

(52) U.S. Cl.
USPC ..... 198/734; 198/494

(58) Field of Classification Search
USPC ..... 198/716–734, 493, 494
See application file for complete search history.

(56) References Cited

U.S. PATENT DOCUMENTS 3,710,963 A * 1/1973 Losch et al. ..... 198/734
4,023,673 A * 5/1977 Hansen ..... 198/494
4,051,948 A * 10/1977 Sackett, Sr. ..... 198/727
4,181,459 A * 1/1980 Price ..... 198/719
4,375,845 A * 3/1983 Chambers et al. ..... 198/725
4,601,629 A * 7/1986 Zimmerman ..... 198/735.3
4,787,497 A * 11/1988 King et al. ..... 198/347.2
5,007,561 A * 4/1991 Wahl et al. ..... 198/716
5,593,019 A * 1/1997 Schlagel ..... 198/721
6,142,291 A * 11/2000 Schulze et al. ..... 198/727
7,000,758 B2 * 2/2006 Bjorklund ..... 198/716
7,748,519 B2 * 7/2010 Freudelsperger ..... 198/550.01
2008/0149462 A1 * 6/2008 Cholet et al. ..... 198/524

FOREIGN PATENT DOCUMENTS

CN 2427494 4/2001
CN 1545475 11/2004
EP 0278774 A2 8/1988

* cited by examiner

*Primary Examiner* — James R Bidwell
(74) *Attorney, Agent, or Firm* — BainwoodHuang

(57) ABSTRACT

A technique for the conveyance of solid combustible material, having at least one conveying means, wherein the conveying means is supported at least partially by bearing means and/or drive means, in particular on a stand, and the apparatus having at least one collecting space located below the conveying means and having a height, at least one deflecting means for the deflection of solid combustible material towards the collecting space being located below at least one bearing means and/or below at least one drive means. Such an apparatus is suitable most especially for the conveyance of solid materials presenting a fire and/or explosion hazard.

20 Claims, 2 Drawing Sheets

TECHNIQUES FOR THE CONVEYANCE OF SOLID COMBUSTIBLE MATERIAL

Figure 1:
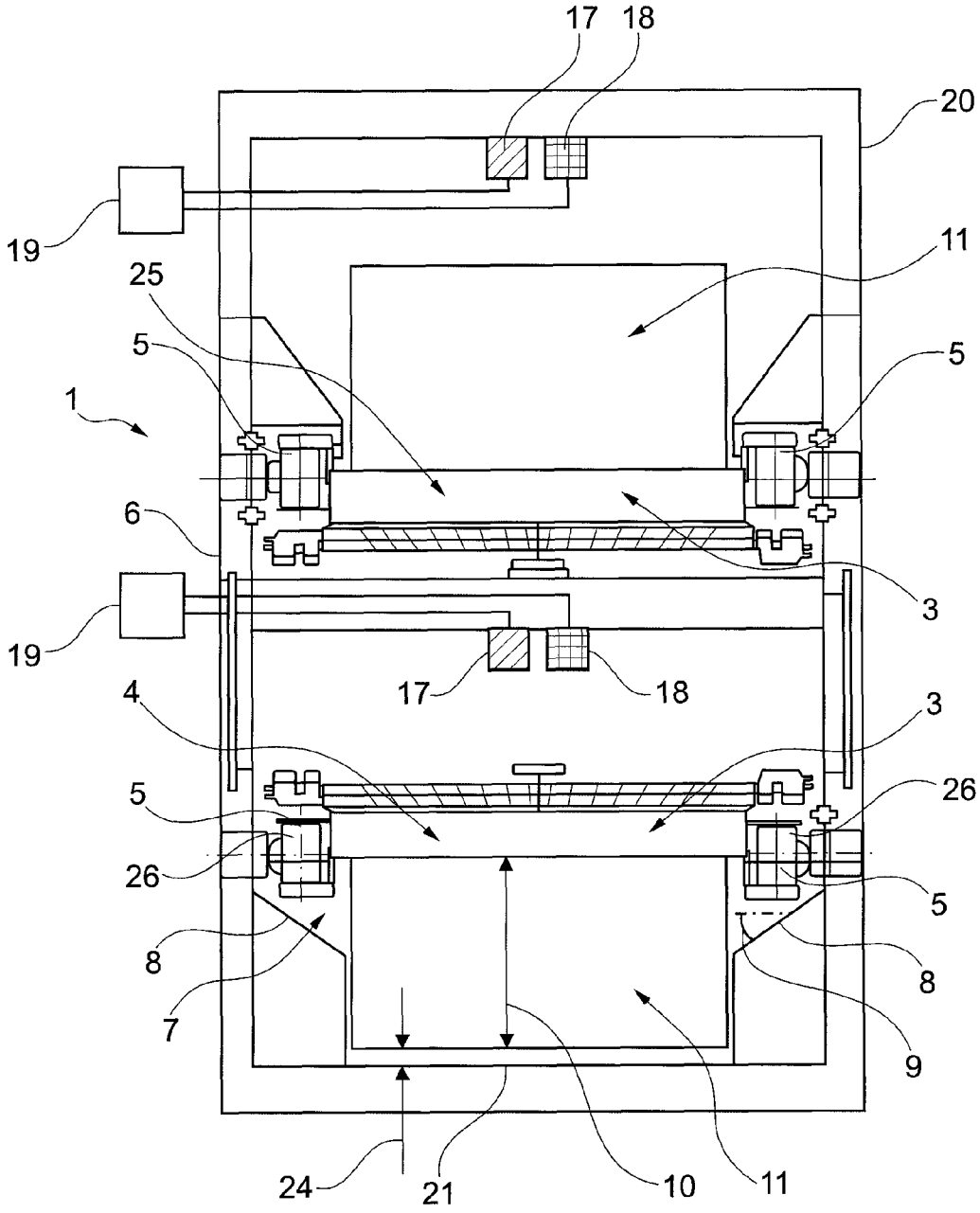

The present invention relates to an apparatus for the conveyance of solid combustible material with the aid of a conveying means. The invention is employed particularly in the conveyance of solid materials presenting a fire and/or explosion hazard.

Conveying means, such as, for example, conveyor belts or drag chain conveyors, are regularly employed in the conveyance of solid combustible material, such as, for example, coal, but also in materials, such as pyrite, which, at least in powdery form, present a fire and/or explosion hazard. These materials often have a significant powdery fraction which may accumulate below the conveying means while the latter is in operation. Since that powdery fraction of the solid material has high inflammability and therefore presents a serious fire and/or explosion hazard, that fraction has to be regularly removed.

In order to convey solid material accumulating below the conveying means back onto a conveying means, in particular, scraper elements may be provided on conveyor belts of conveying means and, while the conveying means is in operation, remove solid material accumulating below the latter. In that context, however, it became apparent that the entire region below the conveying means cannot be cleaned by these scraper elements. Cleaning of regions located laterally next to the conveying means, particularly in regions where the conveying means is supported by bearing means and/or drive means, is not possible with the known conveying means, at least not without considerable outlay in technical terms and/or during operation. However, it is precisely in these regions where especially high temperatures may prevail while the conveying means is in operation. These high temperatures result particularly from warming of the drive means and/or from warming of the bearing means as a result of friction between movable components of the bearing means and also between the bearing means and conveying means. Moreover, in the event of the contact of metallic and/or ceramic constituents and/or impurities of the solid material with movable, particularly rotating drive and/or bearing means, sparking may occur, and therefore deposits of, in particular, powdery material in these regions constitute a considerable hazard.

The object of the invention, therefore, is to solve at least partially problems outlined in respect of the prior art, and, in particular, to specify an apparatus for the conveyance of solid combustible material, which presents a considerably reduced fire and/or explosion hazard during the conveyance of combustible solid material. Furthermore, an especially simple possibility for cleaning such apparatuses during operation is to be specified.

The various described objects are achieved through the use of an apparatus. Further advantageous features of the invention are specified throughout. It should be pointed out that the features listed individually may be combined with one another in any technologically expedient way and define further features of the invention. Furthermore, the features are dealt with in more detail and explained in the description, further preferred features of the invention being presented.

The apparatus according to the invention for the conveyance of solid combustible material has at least one conveying means, wherein the conveying means is supported at least partially by bearing means and/or drive means, in particular on a stand. Further, the apparatus has at least one collecting space located below the conveying means and having a height, at least one deflecting means for the deflection of solid combustible material towards the collecting space being located below at least one bearing means and/or below at least one drive means.

The solid combustible material is, in particular, a material which, at least in a powdery and/or fine-grained state, as easy inflammability and/or is a high explosion hazard. In particular, that material is coal and/or pyrite. The material conveyed with the aid of a conveying means which, in particular, has an upper strand and a lower strand, that conveying means being, in particular, a drag chain conveyor or plate conveyor or belt conveyor. These conveying means regularly have conveying plates for receiving the material to be conveyed, which are fastened to chains and/or to a metal netting which transmit the drive energy of a drive to the conveying plates. The conveying means is supported, particularly in lateral regions (orthogonally) to the conveying direction, by bearing means and/or drive means, in particular bearing rollers, on a (metal) stand. That stand may be, in particular, a (closed) housing of the apparatus, the deflecting means being integrated into the housing below at least one bearing means and/or below at least one drive means of the conveying means.

For the reception of powdery and/or fine-grained material which may accumulate below the conveying means while the latter is in operation, a collecting space is located below the conveying means, in particular below the lower strand and/or the upper strand. That collecting space is regularly delimited at least partially by the conveying means, a bottom and lateral deflecting means. Moreover, that collecting space has a height, that being the distance, perpendicular to the conveying means, between the lower strand and the bottom. The at least one deflecting means is preferably located below at least one bearing means and/or below a drive means of the conveying means and extends most especially preferably in the conveying direction over the length of the conveying means. The deflecting means is preferably adjusted such that it deflects material which falls down from the conveying means into lateral regions of the apparatus directly towards the collecting space. For that purpose, deflection mostly takes place towards central/middle regions of the apparatus below the conveying means, where the collecting space is preferably located. The deposition of such material in the critical regions which are difficult to clean is thus avoided directly.

It is advantageous if at least one deflecting means from the following group is located below the conveying means, in particular below the at least one bearing means and/or below the at least one drive means:

at least one baffle,
at least one scraping tool,
at least one blowing device,
at least one vibrating conveyer.

The baffle has, in particular, an incline in the direction of the collecting space, so that material which has accumulated in the region of the bearing means is conducted at least partially in the direction of the collecting space (for example, in the manner of a chute). It will be made clear here that the at least one baffle may not necessarily be a metal sheet, but may be a plane formed from any material and having an incline in the direction of the collecting space. The baffle plate may be produced as a separate component, but also may be an integral constituent of the stand or the housing. Moreover, the baffle plate may also have scraping tools, with the aid of which material accumulating on the at least one baffle plate can be removed. Nevertheless, scraping tools may also be located, independently of baffle plates, below bearing means and/or drive means and convey the material located there in the direction of the collecting space. Furthermore, blowing devices or vibrating conveyors may also be provided which convey the material continuously or discontinuously in the direction of the collecting space.

It is especially advantageous if the deflecting means comprises a baffle plate with an incline of at least 30°. An incline of the at least one baffle plate of at least 45°, especially preferably 60°, is preferred. That ensures that the material which has accumulated in the region of the bearing means is discharged especially reliably.

Preferably, the at least one deflecting means comprises a baffle plate with reduced friction and/or with a sliding coating. That feature affords an improved conveyance of the material in the direction of the collecting space.

Furthermore, it is advantageous if the height of the collecting space amounts to at least 20 cm. The height of the collecting space of at least 40 cm, especially preferably of at least 60 cm, is preferred. What is achieved thereby is, for example, that the material is collected in the collecting space at a sufficient distance from the bearing means of the lower strand of the conveying means. The removal of the material from the collecting space may take place manually within the framework of the general maintenance intervals of the conveying means or as a function of a filling level of the collecting space. At the same time, a maximum height of the collecting space of 160 cm, preferably of 120 cm and especially preferably of 80 cm is suitable for use.

In an especially preferred embodiment of the invention, the conveying means has mechanical material removers for removal of material from the collecting space. For that purpose, the mechanical material removers are preferably located on and/or below the conveying means, in particular so as to project substantially rigidly and, in particular, over the entire width (orthogonally to the conveying direction of the conveying means), so that these material removers project into the collecting space and, while the conveying means is in operation, remove material which has accumulated in the collecting space. That may take place, in particular, in that the mechanical material removers convey the material out of the collecting space into an extraction container or back onto the conveying means.

Preferably the mechanical material removers are located on the conveying means. In that case, these mechanical material removers are mostly connected rigidly to the conveying means (for example, the conveying plates), although flexible and/or movable mounting is also possible. What is achieved by the latter variant is that the mechanical material removers lie substantially flat on the conveying means as a result of gravity, particularly in the region of the upper strand, and therefore do not reduce the conveying capacity of the conveying means and, in particular, project from the conveying means, only in the region of the lower strand of the latter, into the collecting space lying underneath. For that purpose, the mechanical means may be fastened to the conveying means, for example, by hinges.

It is especially advantageous if the conveying means has at least one mechanical material remover from the following group: scrapers, brushes, rakes.

Preferably, the apparatus has a feed region and a dispensing region. The feed region is that region in the apparatus in which the material to be conveyed is fed out of the conveying means. Correspondingly, the dispensing region is that region in the apparatus in which the conveyed material is dispensed from the conveying means. It is therefore preferable that the collecting space extends over part of the stretch from the feed region to the dispensing region (and the deflecting means, likewise, parallel thereto).

It is especially advantageous if the conveying means or the mechanical material removers are formed of at least partially of metal. The conveying means or the mechanical material removers can thereby be produced so as to be especially robust, so that high conveying performances can be achieved.

In a further embodiment, there is provision for the material to be conveyable by the conveying means from a material store to a combustion chamber of a combustion boiler. The apparatus consequently serves for that purpose for transporting, for example, coal from the material store via the feed region, the conveying means and the dispensing region to a combustion boiler.

Preferably, the apparatus has at least one detecting means for:

a) the filling level of the collecting space, and/or
b) the temperature of the material, and/or
c) the gas composition in the region of the conveying means.

Advantageously, a required removal of the material from the collecting space can be detected by a detecting means for the filling level of the collecting space, particularly when continuous cleaning does not take place. In order to configure the apparatus so that it is especially reliable, it is advantageous if the apparatus has at least one detecting means for the temperature of the material and/or the gas composition in the region of the conveying means. As a result, critical temperatures for inflammation of the material can be detected, and corresponding counter measures, such as, for example, the cooling of the material by cooling air, can be initiated. By detecting means for the gas composition, inflammation of the material can be detected and measures for firefighting can be initiated as soon as possible.

According to a further expedient embodiment, the apparatus has at least one extinguishing device.

It is likewise advantageous if the apparatus has at least one extinguishing control, wherein the extinguishing control is adjusted for activating the at least one extinguishing device. In that case, the extinguishing control may be connected both to the at least one detecting means for the temperature of the material and/or the gas composition and to the at least one extinguishing device in a data-conducting manner. That makes it possible, if a fire is detected, to activate the extinguishing device through the use of the extinguishing control.

In an enhancement of the invention, the conveying means is located at least partially in a housing. Noise emissions and/or dust emissions can thereby advantageously be reduced.

It is especially advantageous if a distance between the mechanical material removers and a bottom of the collecting space amounts to 5 mm to 50 mm. Preferably, the distance between the mechanical material removers and the bottom of the collecting space amounts to 5 mm to 35 mm, especially preferably to 5 mm to 20 mm. As a result, advantageously, on the one hand, it can be ensured that the collecting space is sufficiently cleaned and, on the other hand, sparking due to contact of the mechanical material removers with the bottom is avoided.

In a further embodiment, there is provision for the apparatus to have an extraction container for the reception of material removed from the collecting space. It is basically preferable, however, that the material is conveyed back onto the conveying means.

According to a further aspect of the invention, the use of the apparatus for the transport of coal and/or pyrite is suitable. In particular, the apparatus is used for the conveyance of material intended for combustion to a combustion chamber.

The invention and the technical background are explained in more detail below through the use of the figures. It should be pointed out that the figures show especially preferred design variants of the invention, but that is not restricted to these.

Figure 2:
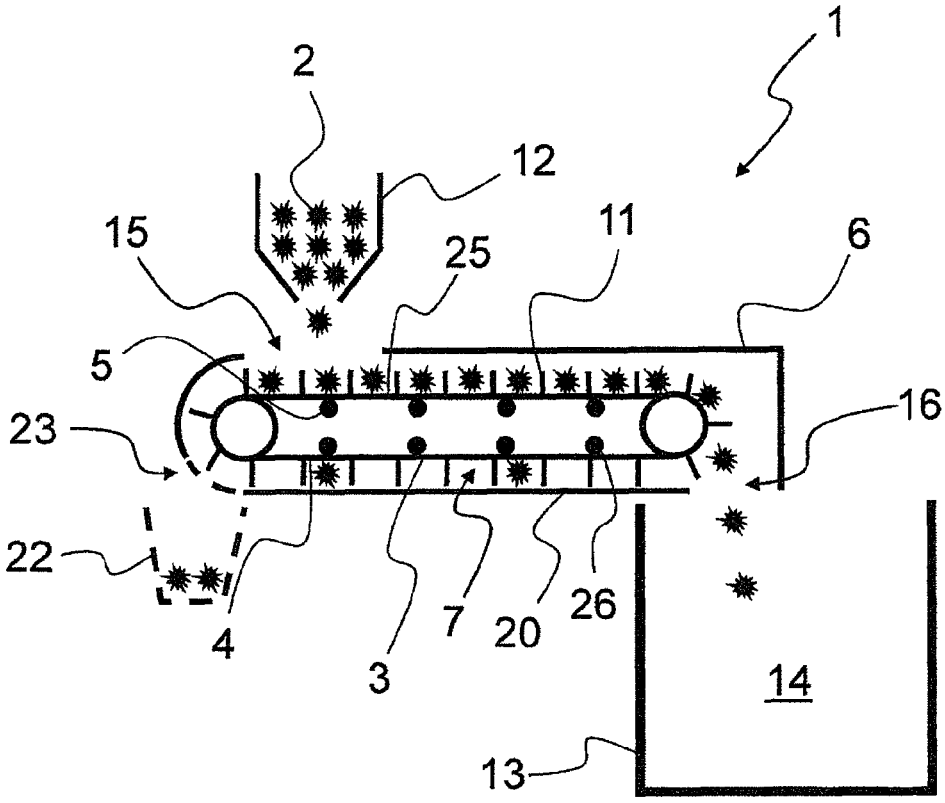

It is schematically shown in:

FIG. 1: a cross-section through an apparatus according to the invention, and FIG. 2: a longitudinal section through an apparatus according to the invention.

FIG. 1 shows a cross-section through an apparatus 1 according to the invention, a conveying means 3 (for example, a conveyer belt) being located with the aid of bearing means 5 (for example, rollers) and drive means 26 (for example, pull chains) in a stand 6 designed in this case as a housing 20. The conveying means 3 has an upper strand 25 and a lower strand 4. Mechanical material removers 11, which are designed in this case as scrapers, are fastened to the conveying means 3. These mechanical material removers 11 project from the lower strand 4 into a collecting space 7 located below the lower strand 4. The collecting space 7 has a height 10 and is delimited by a bottom 21 of the housing 20, by the lower strand 4 and by lateral deflecting means 8 designed as baffle plates. The baffle plates in that case have an incline 9 in the direction of the collecting space 7 in the region below the bearing means 5 and the drive means 26 of the lower strand 4 of the conveying means 3. In order to prevent the mechanical material removers 11 from coming into contact with the bottom 21 of the collecting space 7, a distance 24 is present between the mechanical material removers 11 and the bottom 21.

Furthermore, the apparatus 1 has, above the lower strand 4 and above the upper strand 25, detecting means 17 and extinguishing devices 18 which are in each case connected to an extinguishing control 19 in a data-conducting manner.

FIG. 2 shows an apparatus 1 according to the invention in which a conveying means 3 is located in a stand 6 designed as a housing 20. Both the upper strand 25 and the lower strand 4 of the conveying means 3 are mounted on the housing 20 with the aid of bearing means 5 and drive means 26. The apparatus 1 has a feed region 15 in which material 2 is fed from a material store 12 onto the conveying means 3. The material 2 is subsequently conveyed by the upper strand 25 of the conveying means 3 to a dispensing region 16, via which the material 2 is dispensed into a combustion chamber 14 of a combustion boiler 13. Below the lower strand 4 is provided a collecting space 7 in which, in particular, powdery and/or fine-grained material 2 is accumulated. That collecting space 7 is at least partially delimited by lateral deflecting means, not illustrated here. In order to remove material 2 which has accumulated in the collecting space 7 from the said collecting space, the conveying means 3 has mechanical material removers 11 which convey the material 2 either through an extraction orifice 23 into an extraction container 22, illustrated here by dashes, and/or, preferably, back onto the upper strand 25.

The apparatus for the conveyance of solid combustible material is suitable most especially for the conveyance of solid materials presenting a fire and/or explosion hazard.

List of Reference Numerals

1 Apparatus
2 Material
3 Conveying means
4 Lower strand
5 Bearing means
6 Stand
7 Collecting space
8 Deflecting means
9 Incline
10 Height
11 Mechanical material removers
12 Material store
13 Combustion boiler
14 Combustion chamber
15 Feed region
16 Dispensing region
17 Detecting means
18 Extinguishing device
19 Extinguishing control
20 Housing
21 Bottom
22 Extraction container
23 Extraction orifice
24 Distance
25 Upper strand
26 Drive means

The invention claimed is:

1. Apparatus for the conveyance of solid combustible material, having at least one conveying means, wherein the conveying means is supported at least partially by a support which is at least one of a bearing means and a drive means, on a stand, and the apparatus having at least one collecting space located below the conveying means and having a height, at least one deflecting means, which is constructed and arranged to deflect solid combustible material towards the collecting space, being located directly below the at least one of the bearing means and the drive means.

2. Apparatus according to claim 1, wherein at least one deflecting means from the following group is located below the conveying means, in particular below the at least one bearing means and/or below the at least one drive means, at least one baffle plate,
at least one scraping tool,
at least one blowing device, and
vibrating conveyer.

3. Apparatus according to claim 1, wherein the at least one deflecting means comprises a baffle plate with an incline of at least 30°.

4. Apparatus according to claim 3, wherein the baffle plate comprises reduced friction and/or a sliding coating.

5. Apparatus according to claim 1, wherein the height of the collecting space amounts to at least 20 cm.

6. Apparatus according to claim 1, wherein the conveying means has mechanical material removers for removal of material from the collecting space.

7. Apparatus according to claim 6, wherein the mechanical material removers is located on the conveying means.

8. Apparatus according to claim 6, wherein the conveying means has at least one mechanical material remover from the following group:

scraper, brush, rake.

9. Apparatus according to claim 6, having a feed region and a dispensing region.

10. Apparatus according to claim 6, wherein the conveying means or the mechanical material removers are formed of at least partially of metal.

11. Apparatus according to claim 1, wherein the material is conveyable by the conveying means from a material store to a combustion chamber of a combustion boiler.

12. Apparatus according to claim 1, having at least one detecting means for:

a) the filling level of the collecting space, and/or
b) the temperature of the material, and/or c) the gas composition in the region of the conveying means.

13. Apparatus according to claim 1, having at least one extinguishing device.

14. Apparatus according to claim 13, having at least one extinguishing control, the extinguishing control being adjusted for activating the at least one extinguishing device.

15. Apparatus according to claim 1, wherein the conveying means is located at least partially in a housing.

16. Apparatus according to claim 6, wherein a distance between the mechanical material removers and a bottom of the collecting space amounts to 5 mm to 50 mm.

17. Apparatus according to claim 16, having an extraction container for the reception of material removed from the collecting space.

18. Apparatus according to claim 1 wherein the deflecting means includes a set of baffle plates disposed in a lateral manner with respect to the collecting space.

19. A method of conveying solid combustible material, comprising:

providing an apparatus having at least one conveying means, wherein the conveying means is supported at least partially by a support which is at least one of a bearing means and a drive means, on a stand, and the apparatus having at least one collecting space located below the conveying means and having a height, at least one deflecting means, which is constructed and arranged to deflect solid combustible material towards the collecting space, being located directly below the at least one of the bearing means and the drive means; and transporting, as the solid combustible material, coal and/or pyrite using the apparatus.

20. Apparatus for the conveyance of solid combustible material, having at least one conveying means, wherein the conveying means is supported at least partially by bearing means and/or drive means, in particular on a stand, and the apparatus having at least one collecting space located below the conveying means and having a height, at least one deflecting means for the deflection of solid combustible material towards the collecting space being located below at least one bearing means and/or below at least one drive means;

wherein the apparatus further has at least one extinguishing device, and at least one extinguishing control, the extinguishing control being adjusted for activating the at least one extinguishing device.

* * * * *